US005730098A

United States Patent [19]

Sasaki et al.

[11] Patent Number: 5,730,098

[45] Date of Patent: Mar. 24, 1998

[54] ENGINE SHUT DOWN APPARATUS

[75] Inventors: Asao Sasaki, Noda; Shin-ichi Okazaki, Kasukabe; Masami Minegishi, Urawa, all of Japan

[73] Assignee: Fuji Jukogyo Kabushiki Kaisha, Tokyo, Japan

[21] Appl. No.: 671,135

[22] Filed: Jun. 27, 1996

[30] Foreign Application Priority Data

Jul. 12, 1995 [JP] Japan ..... 7-176138

[51] Int. Cl.[6] ..... F02B 77/00

[52] U.S. Cl. ..... 123/198 DB; 123/198 DC

[58] Field of Search ..... 123/198 DB, 198 DC

[56] References Cited

U.S. PATENT DOCUMENTS 3,251,352 5/1966 Walker ..... 123/198 DC 4,192,279 3/1980 Maisch et al. ..... 123/198 DC

FOREIGN PATENT DOCUMENTS 339181 6/1991 Japan .

*Primary Examiner*—Noah P. Kamen

*Attorney, Agent, or Firm*—Martin A. Farber

[57] ABSTRACT

An engine shut down apparatus of an internal combustion engine having a magneto type ignition system comprises a magneto generator, a power source circuit, an engine stop switch, a fuel cut drive circuit, a fuel cut-off solenoid valve, an engine stop circuit and a fuel cut-off/ignition stop circuit. When the engine stop switch is turned on, in the fuel cut-off/ignition stop circuit, an engine stop instruction signal is sent to the fuel cut-off drive circuit and then the fuel cut-off solenoid valve is operated so as to close the fuel supply to the engine. On the other hand, in the fuel cut-off/ignition stop circuit, the engine stop instruction signal is sent to the engine stop circuit after a specified time has elapsed so as to operate the engine stop circuit with a time lag. Then, the engine stop circuit short-circuits the ignition system so as to stop ignition. Further, the fuel cut-off/ignition stop circuit is electrically separated with respect to electric noises from the ignition system. Thus, the engine shut down apparatus enables the engine to stop smoothly and securely without causing running-on or after-burning under any operating condition.

10 Claims, 2 Drawing Sheets

1
2
3
4
5
6
7
8
9
10
11
12
13
14
15
16
17
Vcc
VIG
POWER SOURCE CKT.
FUEL CUT-OFF DRIVE CKT.
STOP SIGNAL HOLDING CKT.
STOP SIGNAL DELAYING CKT.
STOP SIGNAL INPUTTING CKT.
STOP SIGNAL OUTPUTTING CKT.
ENGINE STOP CKT.
G1
G2

Vcc
VIG
14
15
16
17
13
13a
18
19
R1
R2
R3
R4
R5
R6
R7
PD1
PTR
PD2
PSCR
C1
C2
TR1
SCR
D1
3
4
Ia
G1
G2
SELF HOLDING CKT.

ENGINE SHUT DOWN APPARATUS

BACKGROUND OF THE INVENTION

1. Field of the Invention

The present invention relates to a shut down apparatus for an internal combustion spark ignition engine and particularly to an apparatus for forcedly shutting-down the engine by means of stopping the fuel supply to the engine and halting the ignition.

2. Prior Art

The recent great concern about emissions has resulted in setting the air-fuel ratio of internal combustion spark ignition engines to the rather lean side. As a result, when they are turned off, unfavorable phenomena such as running-on or after-burning tend to occur.

Generally, cutting the fuel supply upon stopping the engine is an effective countermeasure to prevent running-on or after-burning. Japanese Unexamined Patent Application Toku-Kai-Hei 3-39181 discloses a technique in which a solenoid valve disposed in the fuel passage of a carburetor is closed to cut-off the fuel supply to an internal combustion engine. The engine has a generator connected with an output shaft thereof and when the engine undergoes a stopping operation, the solenoid valve is energized so as to close the fuel passage by supplying current from the still rotating generator and a capacitor connected with the generator in parallel. The capacitor delays (lengthens) closing of the solenoid valve by the discharge current from the capacitor.

However, even with the solenoid valve for cutting the fuel supply, depending upon the engine operating conditions such as operating under high temperature or high load, there is a possibility of causing running-on or after-burning because fuel remains at a downstream portion of the solenoid valve after the solenoid valve has closed the fuel passage and because the remaining fuel is sucked into the engine.

In case of small industrial engines or general purpose small engines powering chainsaws, generators and the like, these engines conventionally provide a magneto type of ignition system. In these engines, a power source for driving a fuel cut-off solenoid valve and a control circuit thereof generally are required to be installed within the same housing of the magneto. For that reason, some countermeasure is required to avoid failure or erroneous operation due to high frequency noise generated in the ignition system.

SUMMARY OF THE INVENTION

The present invention has been accomplished considering these circumstances. Therefore, it is an object of the present invention to provide an engine shut down apparatus capable of shutting down the engine smoothly without running-on or after-burning when the engine stops.

It is another object of the present invention to provide an engine shut down apparatus capable of shutting-down the engine securely without being affected by high frequency noise.

DETAILED DESCRIPTION OF THE PREFERRED EMBODIMENTS

Figure 1:
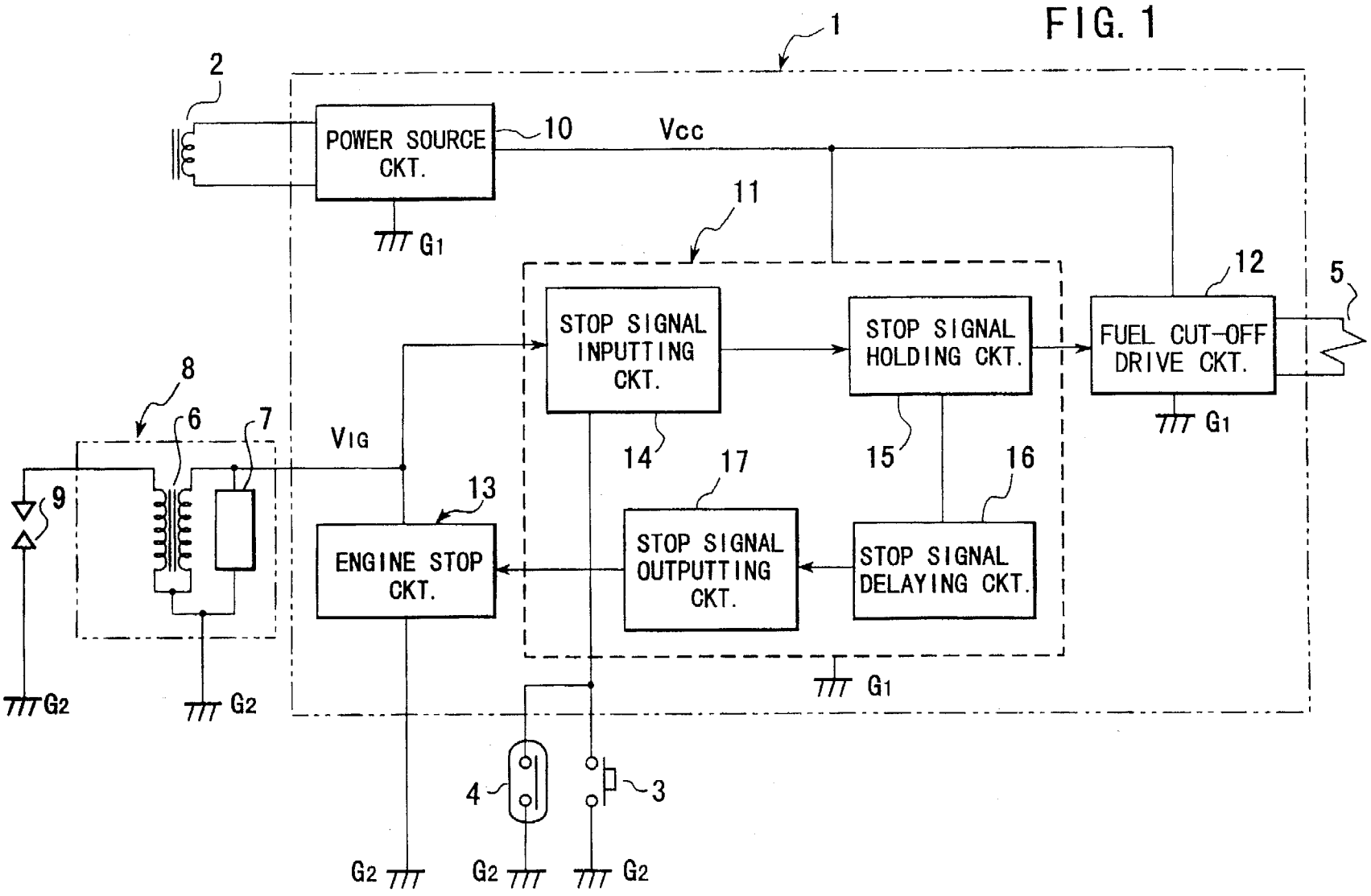
FIG. 1 is a schematic block diagram of an engine shut down apparatus according to the present invention.

Referring now to FIG. 1, there is shown an engine shut down apparatus 1 of a magneto ignition type industrial engine for shutting off the fuel supply to the engine in response to a received engine stop signal and at the same time for halting the ignition so as to shut down the engine forceably. In this embodiment, the engine (not shown) is started by a recoil starter. Further, numeral 2 denotes a power source coil disposed in the magneto for supplying current to a battery, a lamp or the like.

The engine shut down apparatus 1 includes a normally-open type engine stop switch 3 for stopping the engine, a normally-open type oil level switch 4 for stopping the engine based on a signal indicating a shortage of lubrication oil and a solenoid valve (fuel cut-off valve) 5 incorporated in a carburetor (not shown) for shutting off the fuel supply to the engine. Numeral 8 denotes an ignition unit built in the magneto of the engine. The ignition unit 8 comprises an ignition coil 6 for supplying voltage to a spark plug 9 and an ignition circuit 7 for switching on or off the primary side of the ignition coil 6 by a transistor or a mechanical contact point.

In the above-described engine shut down apparatus 1, when an engine stop signal is received from the engine stop switch 3 or the oil level switch 4, the fuel cut-off valve 5 is operated to close the fuel supply to the engine. Then the primary side of the ignition coil 6 is short-circuited so that the spark plug 9 misfires. As a result, the engine is shut down forceably.

The engine shut down apparatus further includes a power source circuit 10 for rectifying (stabilizing the voltage if needed) the alternating voltage output generated in the power source coil 2, a fuel cut-off/ignition stop circuit 11 for cutting-off the fuel and stopping the ignition based on the engine stop signal sent from the engine stop switch 3 or the oil level switch 4, a fuel cut-off drive circuit 12 for driving the fuel cut-off valve 5 and an engine stop circuit 13 for short-circuiting the primary side of the ignition coil 6 based on a signal derived from the fuel cut-off/ignition stop circuit 11.

Further, the fuel cut-off/ignition stop circuit 11 includes a fuel supply cut-off circuit for closing the fuel cut-off valve 5 so as to stop the fuel supply when the engine stop instruction signal is received and an ignition stop circuit for delaying the engine stop signal until a specified time elapses after the fuel cut-off valve 5 has been closed and for then sending an ignition stop operation signal to the engine stop circuit 13.

In detail, the fuel supply cut-off circuit comprises a stop signal inputting circuit 14 for receiving the engine stop instruction signal derived from the engine stop switch 3 or the oil level switch 4 and a stop signal holding circuit 15 for holding a signal derived from the stop signal inputting circuit 14 until the engine is stopped or until the power supply from the power source coil 2 is stopped and for sending a drive control signal (fuel cut-off signal) to the fuel cut-off drive circuit 12. Further, the ignition stop circuit comprises a stop signal delaying circuit 16 for delaying the signal held in the stop signal holding circuit 15 and for sending the signal after a specified time and a stop signal outputting circuit 17.

In this embodiment, the fuel cut-off valve 5 is a normally-open type valve in which the valve opens when deenergized and closes when energized. In case of an engine furnished with a battery, however, the valve is allowed to close when deenergized and open when energized.

In the engine shut down apparatus 1, the power is applied from the power source circuit 10 to the fuel cut-off/ignition stop circuit 11 and the fuel cut-off drive circuit 12. The power source circuit 10, the fuel cut-off/ignition stop circuit 11 and the fuel cut-off drive circuit 12 have a common ground (ground electric potential) G1 With respect to each other. On the other hand, the engine stop switch 3, the oil level switch 4, and the engine stop circuit 13, and the ignition system of the engine have a common ground G2 with respect to each other.

Consequently, since the above engine shut down apparatus 1 has a plurality of circuits whose ground electric potentials are different from each other, not only does trouble occur in signal communications among these circuits, but also there is a fear that erroneous operations will occur due to high frequency noise generated in the ignition system. Hence, in the stop signal inputting circuit 14 and the stop signal outputting circuit 17, the power system of the power source coil 2 is electrically separated from that of the ignition system.

Figure 2:
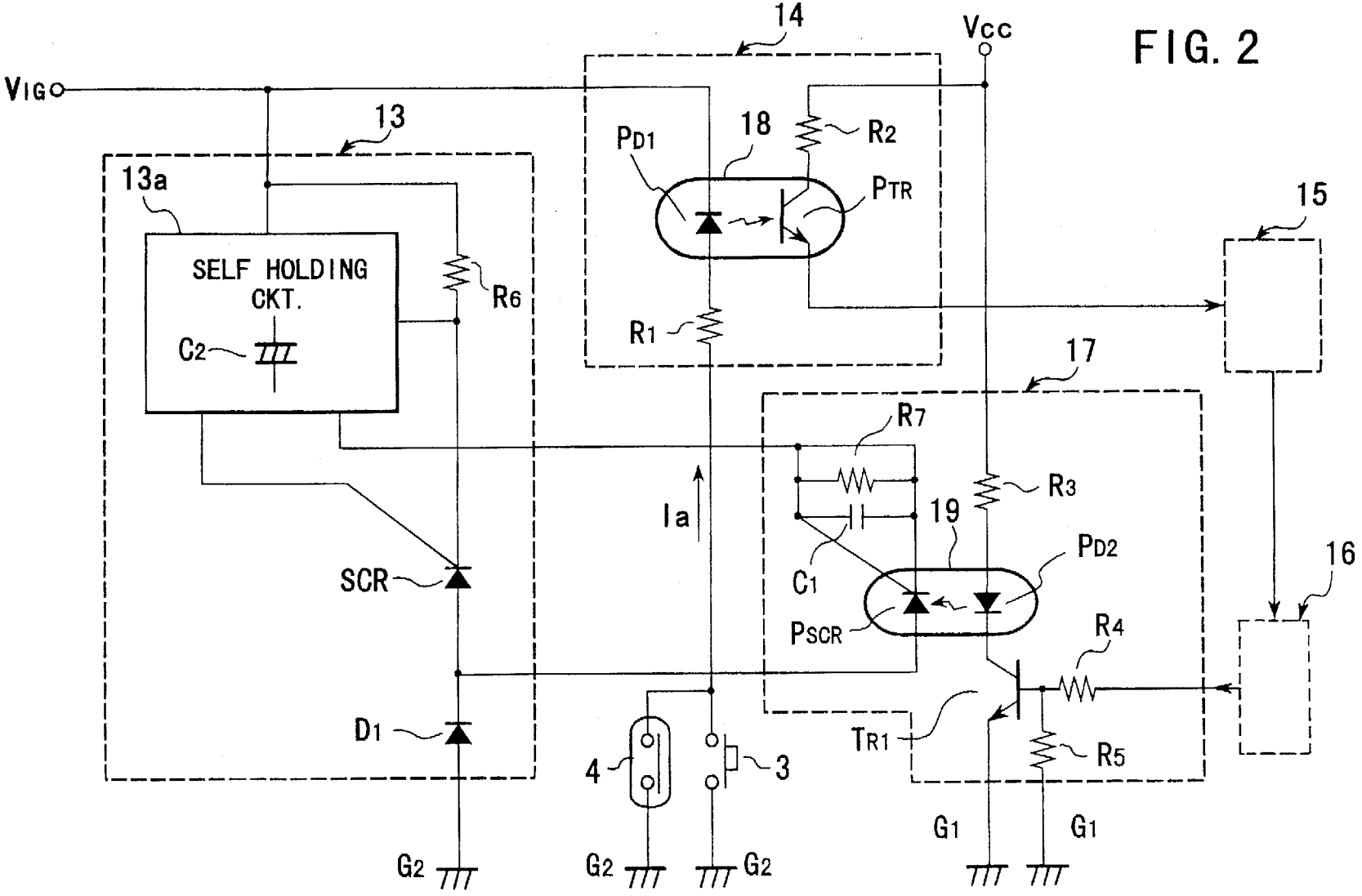
FIG. 2 is a diagram showing a circuit for stopping fuel supply to the engine and spark ignition.

Referring to FIG. 2, in the stop signal inputting circuit 14, there is provided a photocoupler 18 composed of a light emitting diode PD1 and a phototransistor PTR. The cathode side of the phototransistor PD1 is connected with the ignition power source VIG (primary side of the ignition coil 6) and the anode side thereof is grounded to G2 through a resistance R1 and through the engine stop switch 3 or the oil level switch 4 and further the collector side of phototransistor PTR. is connected with the control power source vcc from the power source circuit 10 through a resistance R2, whereby a signal based on the control power source Vcc is sent from the emitter side of the phototransistor PTR to the stop signal holding circuit 15, while the engine stop signal derived by the ignition power source VIG is photo-isolated.

In case where the control power source Vcc is supplied from the power source circuit 10 to the engine stop switch 3 and the oil level switch 4, the photocoupler 18 of the stop signal inputting circuit 14 is not always necessary but the photocoupler enables separating the input signal electrically and therefore applies to any type of input signals from any kind of power sources.

Further, in the stop signal outputting circuit 17, there is provided a photocoupler 19 composed of a light emitting diode PD2 and a photothyristor PSCR. The cathode side of the light emitting diode PD2 is grounded to G1 through a transistor TR1 and the photothyristor PSCR is connected with the engine stop circuit 13. Thus, the engine stop signal (ignition stop operation signal) is sent to the engine stop circuit 13, while a signal derived from the stop signal delaying circuit 16 and based on the control power source Vcc, the signal received at the base of the transistor Tr1 through biasing resistance R4 and R5, is photo-isolated therefrom.

In the engine stop circuit 13, there is provided a thyristor SCR for short-circuiting the primary side of the ignition coil 6. The cathode side of the thyristor SCR is connected with the ignition power source VIG through a resistance R6 and the anode side thereof is connected with the cathode side of the diode D1. The anode side of the diode D1 is connected with the ground G2 (grounded on the engine).

The gate side of the thyristor SCR is connected with a self-holding circuit **13*a*** for automatically retriggering the thyristor SCR once the engine stop signal is received and holding it in a turning-on state until the engine is stopped.

The self-holding circuit **13*a* mainly comprises a holding capacitor C2 for storing an electric charge when the thyristor SCR is turned on and for returning the stored electric charge to the gate side of the thyristor SCR when the thyristor SCR is turned off. Further, in the photothyristor PSCR of the stop signal outputting circuit 17**, a capacitor C1 and a resistance R7 are connected between the cathode side and the gate side thereof in parallel with respect to each other. Also the cathode and anode are connected respectively with the holding capacitor C2 through the resistance R7 and the capacitor C1.

Next, the operation of the shut down apparatus 1 will be described.

When the engine is normally operated, an alternating voltage is fed from the power source coil 2 in the magneto, being synchronized with the revolutions of the engine. The alternating voltage is rectified and smoothed in the power source circuit 10 and therefrom a control voltage Vcc is supplied to the fuel cut-off/ignition stop circuit 11 and the fuel cut-off drive circuit 12. Under the normal operating condition of the engine, no fuel cut-off signal is sent to the fuel cut-off drive circuit 12 and further no engine stop signal is sent to the engine stop circuit 13. Therefore, the fuel cut-off valve 5 incorporated in the carburetor is kept open and the engine stop circuit 13 is in an inoperative condition.

In this condition, the primary side of the ignition coil 6 in the magneto is contacted and broken by the ignition circuit 7 and as a result an ignition voltage VIG with a minus sign is self-induced in the primary side of the ignition coil 6. The ignition voltage VIG generates a high voltage in the secondary side of the ignition coil 6, thereby sparking the spark plug 9 to ignite the gas mixture from the carburetor.

On the other hand, when the engine stop switch 3 is turned on or the oil level switch 4 detects an oil shortage, a contact point of either switch is closed to allow a current Ia to flow through the photodiode PD1 Of the Stop Signal inputting circuit 14 from the ground G2, while the ignition voltage vie is at the minus side, thereby causing the photodiode PD1 to emit light.

As a result of this, the photo-transistor PTR which is photocoupled with the photodiode PD1 is turned on and current is fed from the control power source Vcc to send a signal based on the power source Vcc derived from the power source coil 2 to the next stage, while the signal generated from the ignition voltage VIG is electrically separated.

At the next stage, in the stop signal holding circuit 15, the signal derived from the stop signal inputting circuit 14 is self-held and at the same time a fuel cut-off signal is sent to the fuel cut-off drive circuit 12. In the fuel cut-off drive circuit 12, the fuel cut-off signal is amplified and the amplified signal operates the fuel cut-off valve (solenoid valve) 5. As a result, the fuel cut-off valve 5 is closed to shut off the fuel passage and to stop the fuel supply to the engine.

Then at the same time, on the other hand, a signal is sent from the stop signal holding circuit 15 to the stop signal delaying circuit 16. The signal is delayed therein and a delayed signal is sent to the stop signal outputting circuit 17 after a specified time has elapsed. This delayed time is set to an optimum value determined according to the fuel system of the engine in consideration of the time needed for completely burning the fuel residing downstream of the fuel cut-off valve. In an actual engine, the delayed time would be 1 second or so under no load idling condition.

In the stop signal outputting circuit 17, when the transistor TR1 of the photocoupler 19 is turned on in response to the delayed signal from the stop signal delaying circuit 16, the photodiode PD2 is energized by the control power source Vcc and emits light. As a result, the photothyristor PSCR is turned on to operate the engine stop circuit 13. Then, the capacitor C2 in the self holding circuit **13*a*** is charged by the ignition voltage VIG with a minus sign. When the terminal voltage of the capacitor C2 (voltage applied to the gate of the thyristor SCR) reaches the turn-on voltage, the thyristor SCR for short-circuiting is turned on.

When the thyristor SCR is energized, the primary side of the ignition coil 6 is short-circuited to prevent the ignition of the spark plug 9. Then, again the capacitor C2 is charged and thereafter the thyristor SCR repeats turning-on and turning-off regardless of the existence and non-existence of the engine stop signal.

Thus, whenever the fuel cut-off is executed, the engine stop circuit 13 operates with a time lag. Thereby it is possible to avoid running-on or after-burning caused by the combustion of the residual fuel in the fuel system.

Further, since the engine stop signal derived by the ignition voltage VIG which is received by the control circuit 11 and the operation signal which is sent to the engine stop circuit 13 are electrically separated, the control circuit can be made immune from the high frequency noises generated in the ignition system.

Furthermore, in the aforementioned embodiments the oil level switch has been mentioned as an example of switches for stopping the engine. However other switches such as for example an oil temperature switch or a timer switch may be employed as a switch to produce an engine stop instruction signal. The term engine stop means in the claims includes broadly any type.

While the presently preferred embodiments of the present invention have been shown and described, it is to be understood that this disclosure is for the purpose of illustration and that various changes and modifications may be made without departing from the scope of the invention as set forth in the appended claims.

What is claimed:

1. An engine shut down apparatus of an internal combustion engine having, a fuel system for supplying fuel to said engine, a fuel cut-off valve provided in said fuel system for stopping fuel supply to said engine, an ignition system for providing spark ignition and a magneto for supplying electric power to engine equipment including said ignition system, comprising:

engine stop means for providing an engine stop instruction signal;

fuel supply stopping means for stopping said fuel supply to said engine;

ignition stopping means for stopping said spark ignition;

control means responsive to said engine stop instruction signal for sending a fuel supply stopping signal to said fuel supply stopping means and for sending an ignition stopping signal to said ignition stopping means when a specified time has elapsed since said engine stop instruction signal is sent;

a first power source provided in said magneto for supplying electric power to said ignition system and said ignition stopping means;

a second power source provided in said magneto for supplying electric power to said fuel supply stopping means and said control means; and separating means operatively disposed between said control means and said ignition stopping means for electrically separating said control means from said ignition stopping means such that said ignition stopping signal is unaffected by electrical noise.

2. The engine shut down apparatus according to claim 1, wherein said engine stop means include a manual engine stop switch.

3. The engine shut down apparatus according to claim 1, wherein said engine stop means include an automatic engine stop switch.

4. An engine shut down apparatus having a power source coil in a magneto for generating electric power with an alternating voltage, a power source circuit connected to said power source coil for rectifying and stabilizing said alternating voltage of the electric power, a fuel cut-off drive circuit connected between said power source circuit and a fuel cut-off valve in a fuel system of an engine, an ignition unit provided in said magneto and connected to a spark plug via an ignition coil for supplying high voltage electric power to ignite air-fuel mixture in a cylinder of said engine, the engine shut down apparatus comprising:

engine stop means electrically connected to said engine for sending a stop signal;

a stop signal inputting circuit responsive to said stop signal for producing a stop input signal by said electric power from said power source circuit, and said stop signal inputting circuit including means for separating said stop input signal from said stop signal;

a stop signal holding circuit responsive to said stop input signal and connected to said fuel cut-off drive circuit for generating and sending a fuel cut-off signal to said fuel cut-off drive circuit, and for holding said stop input signal until the engine or the electric power is stopped and for generating a holding signal;

stop signal delaying means responsive to said holding signal for delaying an ignition stop signal for a predetermined time period and for emitting said ignition stop signal after said predetermined time period, and said stop signal delaying means including means for separating said ignition stop signal from said electric power from said power source circuit; and an engine stop circuit responsive to said ignition stop signal for stopping said engine by short-circuiting said ignition coil so as to avoid running-on or after-burning caused by residual fuel in the fuel system, whereby by said separation means erroneous operations due to high frequency noise in said ignition unit are avoided.

5. An engine shut down apparatus according to claim 4, wherein said engine stop means upon actuation is electrically connected to a low voltage terminal of said ignition coil for sending said stop signal of low voltage to said stop signal inputting circuit, and said stop signal inputting circuit separates said stop input signal from said stop signal of low voltage.

6. An engine shut down apparatus having a power source circuit for supplying electric power to a fuel cut-off drive circuit for controlling a fuel cut-off valve in a fuel system of an engine, an ignition unit having a low voltage terminal and being connected to a spark plug via an ignition coil for generating from the low voltage terminal a high voltage electric power to ignite air-fuel mixture in a cylinder of said engine, the engine shut down apparatus comprising:

engine stop means electrically connected to said engine for sending a stop signal;

a stop signal inputting circuit responsive to said stop signal for producing a stop input signal by said electric power from said power source circuit, and said stop signal inputting circuit including means for separating said stop input signal from said stop signal;

a stop signal holding circuit responsive to said stop input signal and connected to said fuel cut-off drive circuit for generating and sending a fuel cut-off signal to said fuel cut-off drive circuit for cutting-off fuel to the engine, and for holding said stop input signal until the engine or the electric power is stopped and for generating a holding signal;

stop signal delaying means responsive to said holding signal for delaying an ignition stop signal for a predetermined time period and for emitting said ignition stop signal after said predetermined time period, and said stop signal delaying means including means for separating said ignition stop signal from said electric power from said power source circuit; and an engine stop circuit responsive to said ignition stop signal for stopping said engine by short-circuiting said low voltage terminal so as to avoid running-on or after-burning caused by residual fuel in the fuel system, whereby by said separation means erroneous operations due to high frequency noise in said ignition unit are avoided.

7. The engine shut down apparatus according to claim 6, wherein said engine stop means includes a manual engine stop switch.

8. The engine shut down apparatus according to claim 6, wherein said engine stop means includes an automatic engine stop switch.

9. An engine shut down apparatus according to claim 7, wherein said engine stop circuit comprises a self-holding circuit with a capacitor and thyristor circuit, and said stop signal inputting circuit and said stop signal delaying means comprise photocouplers for separating the respective signals.

10. An engine shut down apparatus according to claim 6, wherein said engine stop means upon activation is electrically connected to said low voltage terminal for sending said stop signal of low voltage to said stop signal inputting circuit, and said stop signal inputting circuit separates said stop input signal from said stop signal of low voltage.

* * * * *